US006817036B1

(12) United States Patent
Reitz

(10) Patent No.: US 6,817,036 B1
(45) Date of Patent: Nov. 16, 2004

(54) DECORATIVE FACE MASK FOR USE AT SPORTING EVENTS

(76) Inventor: Neal M. Reitz, 3151 Airway Ave., Unit R-2, Costa Mesa, CA (US) 92626

( * ) Notice: Subject to any disclaimer, the term of this patent is extended or adjusted under 35 U.S.C. 154(b) by 0 days.

(21) Appl. No.: 10/666,395

(22) Filed: Sep. 18, 2003

Related U.S. Application Data

(63) Continuation of application No. 10/347,813, filed on Jan. 21, 2003, now Pat. No. 6,671,886.

(51) Int. Cl.[7] ..... A42B 1/24
(52) U.S. Cl. ..... 2/209.13; 2/206
(58) Field of Search ..... 2/209.13, 9.1; 128/857

(56) References Cited

U.S. PATENT DOCUMENTS

| | | | | | |
|---|---|---|---|---|---|
| 1,485,160 | A | | 2/1924 | Bassan | |
| 1,673,859 | A | * | 6/1928 | Wittcoff | 2/10 |
| 3,016,545 | A | | 1/1962 | Donahue | |
| 5,035,004 | A | * | 7/1991 | Koester | 2/206 |
| 5,471,684 | A | | 12/1995 | Casale | |
| 5,551,087 | A | | 9/1996 | Blutstein et al. | |
| 5,617,584 | A | | 4/1997 | Brennan | |
| 5,666,668 | A | * | 9/1997 | Ronquillo | 2/172 |
| 5,940,886 | A | | 8/1999 | McCarthy Smith | |
| 5,950,241 | A | * | 9/1999 | Gomez | 2/172 |
| 6,671,886 | B1 | * | 1/2004 | Reitz | 2/209.13 |

* cited by examiner

*Primary Examiner*—Katherine Moran
(74) *Attorney, Agent, or Firm*—Stetina Brunda Garred & Brucker

(57) ABSTRACT

There is provided a decorative mask for a face of a user wearing a head-wear. The decorative mask includes a mask body. A fastener strap is elongated from the mask body. This fastener strap has two end portions which are adapted to extend through the head-wear and be attached with each other. By attaching such end portions through the head-wear, the mask body can be desirably disposed over the face of the user.

17 Claims, 3 Drawing Sheets

DECORATIVE FACE MASK FOR USE AT SPORTING EVENTS

CROSS-REFERENCE TO RELATED APPLICATIONS

The present application is a continuation of U.S. patent application Ser. No. 10/347,813, now U.S. Pat. No. 6,671,886, entitled DECORATIVE FACE MASK FOR USE AT SPORTING EVENTS filed Jan. 21, 2003, the entirety of the disclosures of which are expressly incorporated herein by reference.

STATEMENT RE: FEDERALLY SPONSORED RESEARCH/DEVELOPMENT (Not Applicable)

BACKGROUND OF THE INVENTION

The present invention relates generally to rally devices for sporting events, and more particularly to a unique type of rally device comprising a decorative mask adapted to engage a rear portion of a sports cap through its ventilation holes such that a simple reversal of the cap enables the mask to be disposed over its user's face.

Sports enthusiasm is an integral part of today's sporting events. It is a common practice for sports fans to cheer for their home/favorite team during a sporting event such as a baseball, football or hockey game. Such cheering typically intensifies when the fans want to motivate or rally their home/favorite team at critical times in the game.

As is well known, sports fans typically clap their hands, whistle, stomp their feet, yell and scream to motivate and rally their team. Additionally, various devices have been used by users at sporting events such as megaphones, "thunder sticks", air horns and sirens to provide increased audible motivation. In addition, numerous visual motivation devices have been utilized such as flags, banners, pennants, towels and the like which, when waved in unison and in combination with audible motivation, is effective in attempting to rally the team players. Further, it has been known for baseball players and the like to attempt to motivate their own team members while sitting on the bench or sidelines by cocking the bill of the baseball cap or inverting the orientation of the baseball cap. Such inversion or cocking is often times known as "putting on a rally cap or rally hat" which provides a visual indication to the players as well as the fans to provide additional audible motivation to support a rally.

Although all such motivational/rally devices and practices are and will continue to be utilized, there is a need in the art for a unique type of rally device that can optimally promote sports enthusiasm among the fans, especially in sporting venues. Further, there is a desire for a unique rally device which can achieve such objective in a convenient and user-friendly manner.

BRIEF SUMMARY OF THE INVENTION

The present invention specifically promotes the motivational/rally spirit and fan participation during a sporting event in a novel and creative manner which can be used in combination with the above-referenced conventional rally devices and practices. More particularly, the present invention comprises a unique type of rally device in the form of a decorative face mask. The face mask is specifically adapted to conveniently engage a rear portion of a conventional head-wear such as a sports cap. As will be demonstrated below, such arrangement allows the face mask to be carried upon the head-wear and disposed about the rear of a user's neck during the sporting event. When desired to promote fan and/or sports rally/motivation, the face mask may be readily positioned over the face through a simple reversal of the head-wear. Furthermore, it should be expressly noted herein that the face mask may additionally be used without the attachment to any type of head-wear, but rather may be releasably worn directly upon the user's head.

In accordance with a preferred embodiment of the present invention, there is provided a decorative face mask which encourages sports fans to actively participate in a sporting event through visual motivation of their home or favorite sports team. For purposes of this application, the terminology "sporting event" should be construed very broadly to include any type of individual or team sporting event or motivational event that involve some degree of cheering and/or motivation by the fans (e.g., baseball, basketball, football, hockey, soccer, bowling, tennis, political and/or educational rally and the like).

The decorative face mask of the present invention includes a mask body which is preferably fabricated from a rigid or semi-rigid polymer material. However, the use of other rigid, semi-rigid or flexible materials (e.g., rubber, thickened paper, etc.) is specifically contemplated herein. The mask body may be sized and configured in differing styles to extend over the entirety or portions of the user's face. However, it is preferably sized so as to expose the user's mouth through the mask body. Of course, the mask body should accommodate the user's face by providing a pair of eye holes and a nose-receiving region which can all selectively vary in size and shape depending upon the desired aesthetic and facial features of the user.

The mask body includes an outer surface which is visually apparent to observers when the mask body is disposed over the user's face. Although such outer surface may be left undecorated, it is highly desirable that the outer surface include painting, shading, surface orientation and/or some kind of printed indicia thereon. More specifically, the outer surface of the mask body preferably displays a design which can be viewed by others. Such design may be chosen from a wide range of selections such as, for example, designs of a facial expression (e.g., angry, smile or excited), home or favorite sports team colors, and/or rally/motivational slogans and/or terminology. One optimal design creation well suited for the outer surface is a sports team or college logo.

In the preferred embodiment of the present invention, an elongate fastener strap is provided with the mask body. Although any number of fastener straps may be provided, the use of one elongate fastener strap is adequate for disposing the mask body over the user's face. In particular, the fastener strap is attached to the mask body and preferably includes two end portions which extend outwardly therefrom on opposing sides of the mask body. The elongated fastener strap may be attached to the mask body in any manner or fashion such as through the use of mechanical fasteners or adhesives. However, one preferred manner of attaching the fastener strap is to utilize the apertures (preferably two apertures) formed through the mask body adjacent opposing sides of its upper portion wherein the elongate fastener strap extends through each of the apertures.

The two end portions of the fastener strap are designed to releasably engage with each other so as to ultimately mount the mask body either directly over the user's face or indirectly over the user's face by way of a sports cap. In this regard, the end portions can be simply tied around the user's head. However, it is preferred that they are attached to each other through the use of releasable fasteners. Although various types of fastening devices may be utilized, hook and loop fasteners are preferred as they can be releseably attached to each other.

In the preferred embodiment, the two end portions of the strap are used to mount the face mask to head-wear of the user. The head-wear preferably comprises a cap such as a sports cap. As is well known, virtually every cap possesses a number of ventilation holes formed therein. The ventilation holes may be used in conjunction with the fastener strap to adjustably mount the face to the cap.

The mask body is initially positioned adjacent the rear portion of the cap such that the mask body's upper edge is proximal to the rear portion of the cap. The upper edge of the mask body may be tucked inside the cap or placed outside the cap.

The mask body can then be secured to the cap by extending the fastener strap's end portions through at least one ventilation hole of the cap. However, the use of at least two ventilation holes is preferred. Such extension through the ventilation holes may be accomplished in two different ways. In the first extension, the end portions can start from the outside of the cap and then be inserted into the respective ventilation holes so that they may then be extended around the user's head and attached together between the cap and the user's head. Alternatively, such end portions may be taken out of their respective ventilation holes from the inside of the cap so as to allow them to externally extend around the cap for attachment to each other. Although the above use of the ventilation holes is preferred, it is recognized herein that the second end portions may simply be extended and attached around the user's head or cap without resorting to the use of the ventilation holes.

As briefly described above, in its rally position, the mask body is disposed over the user's face with the design of its outer surface being visually apparent. Further, in this rally position, the mask does not extend over the user's mouth such that the user is not prohibited from drinking, eating, shouting, talking or making other audible sounds.

The decorative face mask of the present invention is used for rallying/motivating a sports team. In its non-rally position, the mask is carried by the cap adjacent the rear of the user's neck. When desired to initiate a rally position, the user can simply reverse the orientation of the cap so as to dispose the face mask over the user's face. This allows the mask's rally design such as the team logo or colors to be visually displayed. By doing so, the user can demonstrate his or her support for the team and motivate its players.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
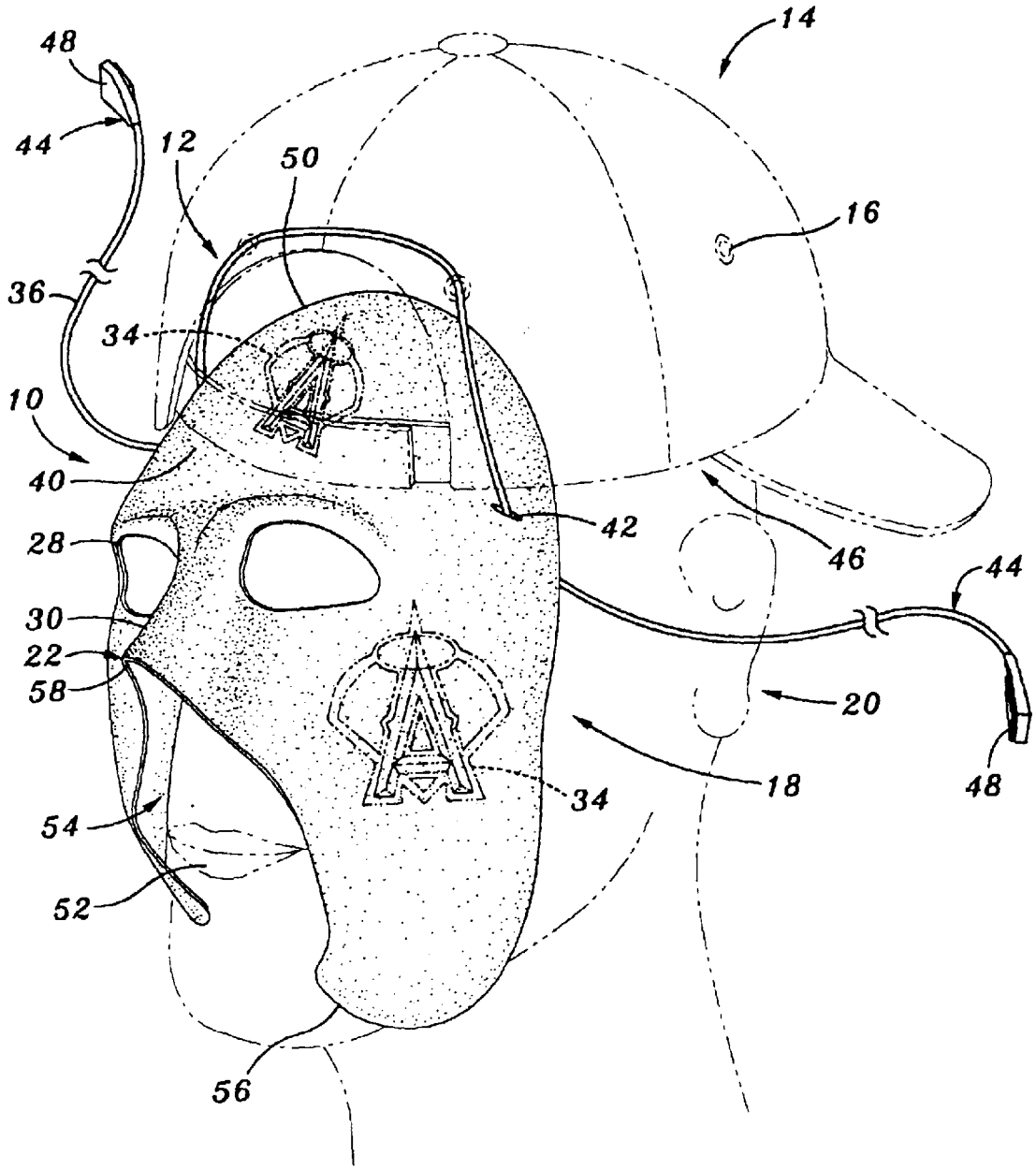
FIG. 1 is a perspective view of a decorative face mask constructed in accordance with a preferred embodiment of the present invention and illustrating its outer surface which may display a differing indicia thereon.

Referring now to the drawings wherein the showings are for purposes of illustrating preferred embodiments of the present invention only, and not for purposes of limiting the same, FIG. 1 illustrates the decorative face mask 10 constructed in accordance with a preferred embodiment of the present invention. As indicated above, the face mask 10 may be specifically adapted to conveniently engage a rear portion 12 of a head-wear 14 through one or more ventilation holes 16 formed in the head-wear 14. This allows the face mask 10 to be carried or stowed on the rear of the neck 15 of a user and be quickly positioned over the face 18 of its user 20 by simply reversing the orientation of the head-wear 14.

Such ability facilitates the user 20 to easily and quickly signal a rally condition to help motivate a sports team during certain times of the sporting event. It is recognized herein that the face mask 10 may be alternatively utilized without the need to engage with any type of head-wear 14, the details of which will be explained below.

As illustrated in FIG. 1, the decorative face mask 10 includes a mask body 22 preferably constructed from a generally rigid and/or semi-rigid plastic material. However, other types of materials such as paper, metal or wood, may be used in addition to plastic. Moreover, it should be further realized that the use of semi-rigid or flexible materials such as rubber or card stock may be utilized.

The mask body 22 may be sized and configured in differing styles to extend over the entirety or portions of the user's face 18. However, it is preferably sized in a manner as to expose its user's mouth 52 through the mask body 22. This aspect of the invention will be discussed shortly below. Of course, the mask body 22 should be accommodating to its user's face 18 by providing a pair of eye holes 28 and a nose-receiving region 30. The pair of eye holes 28 and the nose-receiving region 30 can be variably sized and shaped depending upon the desired aesthetic and facial features of the user 20 and/or the manufacturer's choice and judgment.

The mask body 22 defines an outer surface 32. This outer surface 32 is intended to be visually apparent to observers when the mask body 22 is accommodated over the user's face 18. It is noted herein that such outer surface 32 may be left undecorated. However, it is highly desirable that the outer surface 32 include painting, shading., surface orientation and/or some kind of printed indicia thereon. More specifically, the outer surface 32 of the mask body 22 preferably displays a design 34 which can be viewed by others. Such design 34 may be chosen from a wide range of selections such as, for example, designs of a facial expression (e.g., angry, smile or excited), home or favorite sports team colors, and/or rally/motivational slogans and/or terminology. One optimal design creation that would be well suited for the outer cover 32 is a sports team or college logo.

Figure 2:
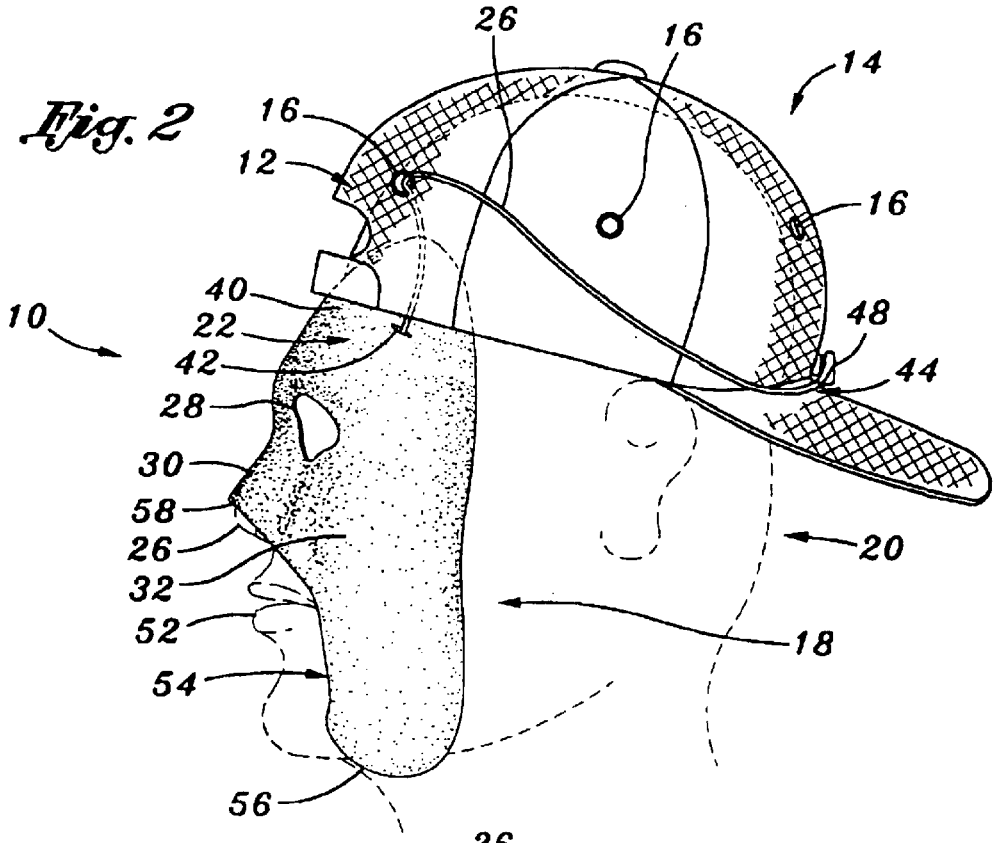
FIG. 2 is a side view of the decorative face mask shown in FIG. 1 illustrating its elongated fastener strap which has end portions that are attached to each other after being extended through ventilation holes formed in a cap.
Figure 3:
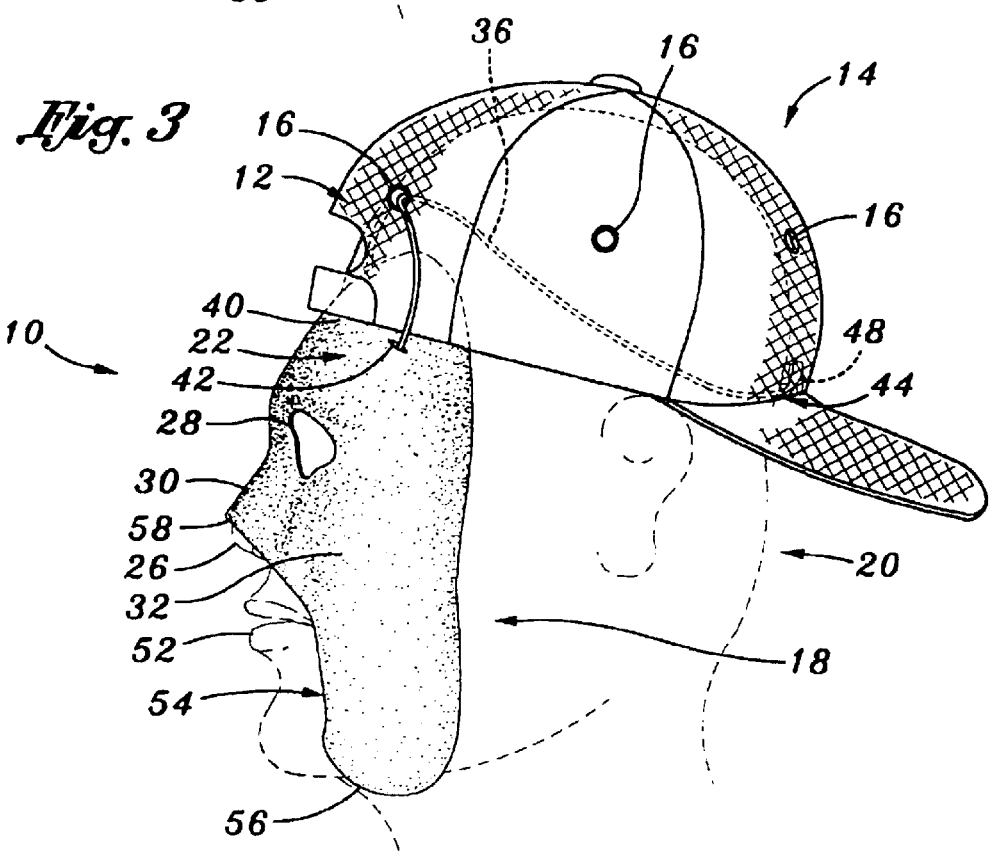
FIG. 3 is a side view of the decorative face mask shown in FIG. 1 illustrating its elongated fastener strap which has end portions that are attached to each other after being extended through their respective ventilation holes formed in the cap.
Figure 4:
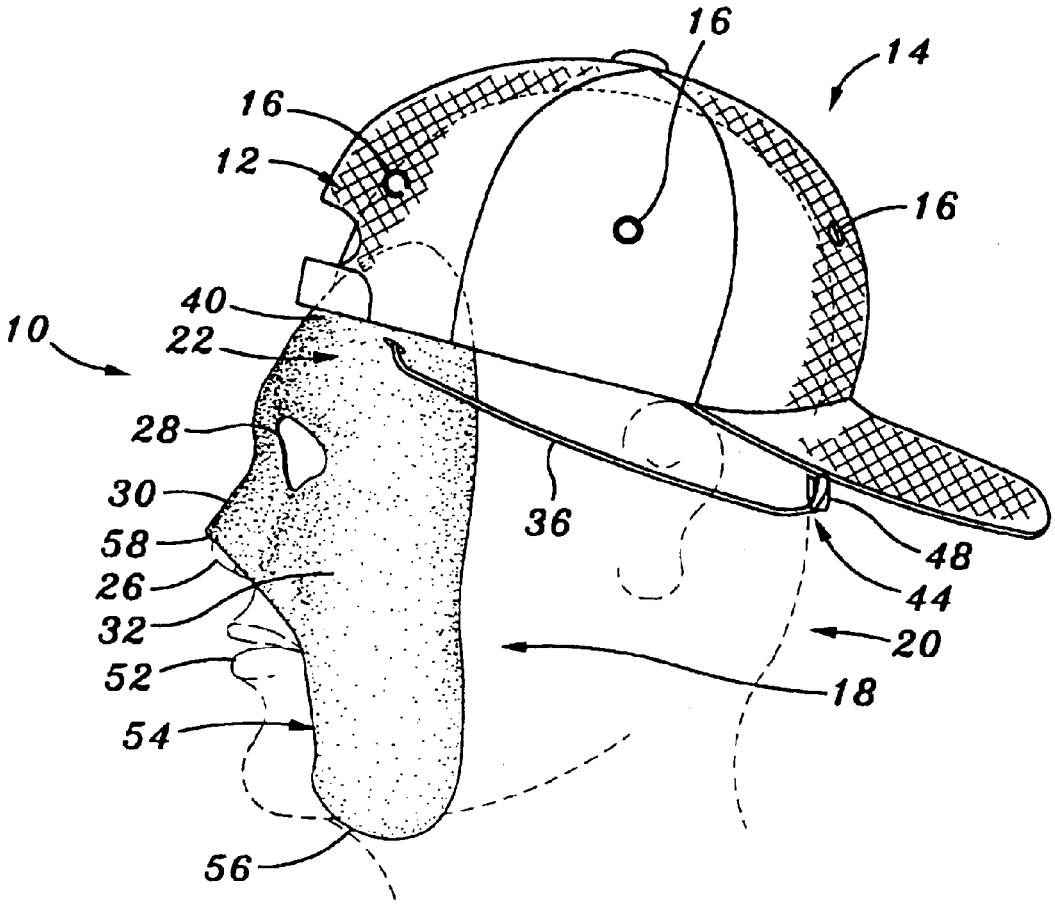
FIG. 4 is a side view of the decorative face mask shown in FIG. 1 illustrating its elongated fastener strap which has end portions that are attached to each other after being extended around the side of a wearer's head.

Referring more particularly to FIGS. 2–4, the mask body 22 comprises an elongate fastener strap 36. Although any number of fastener straps 36 may be provided, the use of one elongate fastener strap 36 is sufficient for disposing the mask body 22 over the user's face 18. In particular, the fastener strap 36 is attached to the mask body 22 and preferably has two end portions 44 which extend away therefrom on opposing sides of the mask body 22. The elongated fastener strap 36 may become attached to the mask body 22 in any manner or fashion such as through the use of mechanical fasteners or adhesives.

FIG. 1 illustrates one specific manner of attaching the fastener strap 36 to the upper portion 40 of the mask body 22. More specifically, the upper portion 40 preferably forms two apertures 42. These apertures 42 are selectively formed through the mask body 22 adjacent opposing sides of its upper portion 40. As such, the elongate fastener strap 36 can be securely anchored to the mask body 22 by extending through each of the apertures 42 thereof.

Referring now to FIGS. 1 and 4, the end portions 44 of the fastener strap 36 are specifically sized and configured to engage with each other so as to ultimately place the mask body 22 either directly over the user's face 18 or indirectly over the user's face 18 by way of a sports cap 14. In this regard, these end portions 44 can be simply tied around the user's head 46 to accomplish such purpose (best shown in FIG. 4). However, it is preferred that they become attached to each other through the use of fasteners 48 which can be either formed at the second end portions 44 or closely adjacent thereto. Although various types of fastening devices may be utilized, hook and loop fasteners are the fasteners of choice as they can be releasably attached to each other.

As shown in FIGS. 2 and 3, the application of the decorative face mask 10 is optimally achieved through the cooperative use of a head-wear 14. The head-wear 14 is preferably a cap, and even more preferably a sports cap. As is well known, virtually every cap possesses ventilation holes 16 for aerating their insides. AS will be explained immediately below, the decorative face mask 10 of the present invention can be desirably employed through utilizing such ventilation holes 16.

The mask body 22 is first positioned adjacent the rear portion 12 of the cap 14. Preferably, such positioning defines an arrangement which disposes an upper edge 50 of the mask body 22 proximal to the rear portion 12 of the cap 14. It should be noted that such upper edge 50 may be tucked inside the cap 14 or alternatively placed outside the cap 14.

The mask body 22 can then be secured to the cap 14 by extending the end portions 44 of the fastener straps 36 through at least one ventilation hole 16. However, the use of at least two ventilation holes 16 is preferred. The extension of the fastener strap 36, and more particularly its end portions 44 may be accomplished in two different ways. In the first extension, the end portions 44 of the fastener strap 36 can start from the outside of the cap 14 and then be inserted into the respective ventilation holes 16 of the cap 14. The end portions 44 may then be extended around the user's head 46 and attached together between the cap 14 and the user's head 46.

In an alternative extension, such end portions 44 may be taken out of their respective ventilation holes 16 from the inside of the cap 14 so as to allow them to externally extend around the cap 14 for attachment to each other. Although the above use of the ventilation holes 16 is preferred, it is recognized herein that the two end portions 44 may simply be extended and attached around the user's head 46 or cap 14 without resorting to the use of the cap's ventilation holes 16.

As briefly described above, in its rally position, the mask body 22 is disposed over the user's face 18 with the design 34 of its outer surface 32 being visually apparent. Additionally, in this rally position, the mask body 22 does not extend over the user's mouth 52 such that the user is not prohibited from drinking, eating, talking, shouting or making other audible sounds. This can be done through the use of a concaved portion 54 formed about a lower edge 56 of the mask body 22.

More particularly, the mask body 22 defines a portion which concaves inwardly thereinto at its lower edge 56, hence locating the lower central edge 58 generally centrally within the concaved portion 54. This allows the user's mouth 52 to be exposed through the concaved portion 54 without the mask 10 getting in its way. When putting on the decorative face mask 10, it is preferred that the lower central edge 58 becomes disposed about or slightly above the user's nose 26. However, the lower central edge 58 may alternatively be defined slightly below the user's nose 26 but above his or her mouth 52. In this respect, it is expressly contemplated herein that a pair of nose holes (not shown) may be optionally provided through the mask body 22 adjacent the lower central edge 58 when the latter arrangement is formed.

The decorative face mask 10 of the present invention is used for rallying/motivating a sports team. In its non-rally position, the mask 10 is carried by the cap 14 adjacent the rear of the user's neck 15. When desired to initiate a rally position, the user 20 can simply reverse the orientation of the cap 14 so as to dispose the face mask 10 over the user's face 18. This allows the mask's rally design 34 such as the team logo or colors to be visually displayed. By doing so, the user 20 can demonstrate his or her support for the team and motivate its players.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A decorative mask for a face of a wearer, the wearer having a head with a rear head portion, the face mask comprising:

a head-wear wearable upon the head of the wearer and having a rear crown portion disposable about the rear head portion;

a mask body;

a fastener strap elongated from the mask body and having end portions, the end portions being adapted to extend through the rear crown portion of the head-wear and having hook and loop fasteners configured to be releasibly attached with each other for engaging the mask body to the rear crown portion of the head-wear, wherein the head-wear is rotatable about the head until the rear crown portion is moved away from about the rear head portion and becomes disposed above the face so as to position the mask body over the face of the wearer.

2. The mask of claim 1 wherein the mask body defines an upper portion and the fastener strap is attached thereto.

3. The mask of claim 1 wherein the mask body defines an outer surface displaying a selected design thereon.

4. The mask of claim 3 wherein the selected design is a sports team logo.

5. The mask of claim 1 wherein the head-wear includes holes for accommodating the end portions of the fastener strap therethrough.

6. The mask of claim 5 wherein the holes are ventilation holes.

7. The mask of claim 1 wherein the hook and loop fasteners are attachable with each other outside of the head-wear.

8. The mask of claim 1 wherein the hook and loop fasteners are attachable with each other inside of the head-wear.

9. The mask of claim 1 wherein the mask body defines an upper edge, the upper edge being disposable adjacent the rear crown portion.

10. The mask of claim 1 wherein the mask body defines a lower edge forming a concaved portion and the face of the wearer includes a mouth, the concaved portion being sized and configured to expose the mouth of the wearer therethrough.

11. The mask of claim 10 wherein the lower edge has a lower central edge defined within the concaved portion and the face of the wearer further includes a nose, the lower central edge being disposable about the nose and above the mouth of the wearer.

12. A method of rallying a team by a wearer, the wearer having a face and a head with a rear head portion, the method comprising the steps of:

a) watching a sporting event;

b) obtaining a head-wear having a rear crown portion and a face mask having an outer surface and an elongated fastener strap with end portions, the end portions having hook and loop fasteners;

c) engaging the mask to the rear crown portion of the head-wear by extending the end portions therethrough and releasibly attaching the hook and loop fasteners together;

d) wearing the head-wear upon the head of the wearer in a manner as to dispose the rear-crown portion about the rear head portion;

e) rotating the head-wear about the head until the rear crown portion is moved away from about the rear head portion and becomes disposed above the face so as to position the mask over the face of the wearer;

f) displaying a design of the team located on the outer surface of the mask; and g) motivating the team to rally during the sporting event.

13. The method of claim 12 wherein the face mask in step b) is fabricated from a plastic material.

14. The method of claim 12 wherein step c) comprises:

1) defining a cap having ventilation holes; and 2) extending each of the end portions through a corresponding one of the ventilation holes.

15. The method of claim 12 wherein the hook and loop fasteners of the end portions are releasibly attached to each other outside of the cap.

16. The method of claim 12 wherein the hook and fasteners of the end portions are releasibly attached to each other inside of the cap.

17. The method of claim 12 wherein the design of the team in step f) is a sports team logo.

* * * * *